US007812319B2

(12) United States Patent
Diehl et al.

(10) Patent No.: US 7,812,319 B2
(45) Date of Patent: Oct. 12, 2010

(54) BEAM GUIDING MAGNET FOR DEFLECTING A PARTICLE BEAM

(75) Inventors: Dirk Diehl, Erlangen (DE); Rene Gumbrecht, Herzogenaurach (DE); Eva Schneider, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 381 days.

(21) Appl. No.: 12/112,846

(22) Filed: Apr. 30, 2008

(65) Prior Publication Data

US 2009/0321654 A1 Dec. 31, 2009

(30) Foreign Application Priority Data

May 4, 2007 (DE) ..... 10 2007 021 033

(51) Int. Cl.
*H01J 1/50* (2006.01)

(52) U.S. Cl. ..... 250/396 ML; 250/492.1; 250/492.3; 335/210; 335/213; 335/214

(58) Field of Classification Search ..... 250/396 ML, 250/492.1, 492.3; 335/210, 213, 214, 301
See application file for complete search history.

(56) References Cited

U.S. PATENT DOCUMENTS 4,680,565 A * 7/1987 Jahnke ..... 335/216
4,870,287 A 9/1989 Cole et al.
5,625,331 A * 4/1997 Yamada et al. ..... 335/216
6,635,882 B1 10/2003 Pavlovic et al.

FOREIGN PATENT DOCUMENTS

DE 199 04 675 A1 8/2000
JP 11144900 5/1999

OTHER PUBLICATIONS

European Search Report dated Aug. 19, 2008.
A. Dael, et al., "Design Study of the Superconducting Magnet for a large Acceptance Spectrometer", IEEE Transactions on Applied Superconductivity, vol. 12, No. 1, Mar. 2002, Seiten 353 bis 357.

* cited by examiner

*Primary Examiner*—Jack I Berman
*Assistant Examiner*—Michael Maskell
(74) *Attorney, Agent, or Firm*—Brinks, Hofer, Gilson & Lione

(57) ABSTRACT

A beam guiding magnet includes a first and second coil system, which are designed such that the dipole moments of the first and second coil systems point in opposite directions. Since the dipole moments of the first and second coil systems point in opposite directions, the two dipole moments at least partially compensate for one another. The resultant dipole moment of the beam guiding magnet may be reduced. The beam guiding magnet may take into account that the remote field of a beam guiding magnet can be lowered by a reduction in the dipole moment of the beam guiding magnet. The dipole moment decreases with the cube of the distance from the beam guiding magnet. A quadruple moment, which on attenuation of the dipole moment represents the next strongest field component, decreases with the fifth power of that distance.

20 Claims, 4 Drawing Sheets

BEAM GUIDING MAGNET FOR DEFLECTING A PARTICLE BEAM

The present patent document claims the benefit of German Patent Application No. DE 10 2007 021 033.9, filed May 4, 2007, which is hereby incorporated by reference.

BACKGROUND

The present embodiments relate to a beam guiding magnet for deflecting a beam of electrically charged particles along a particle path.

Curved beam guiding magnets are widely used in particle accelerator systems for deflecting and/or focusing a beam of charged particles, such as electrons or ions. The particles accelerated to high kinetic energies in such a particle accelerator system are used increasingly in medical treatment, such as cancer treatment. DE 199 04 675 A1 discloses a beam guiding magnet and an irradiation system with a beam guiding magnet. U.S. Pat. No. 4,870,287 discloses an irradiation system for medical treatment. The irradiation systems include a particle source and an accelerator for generating a high-energy particle beam. The high-energy particle beam is aimed at a region of a subject (treatment area), such as a growth, that is to be irradiated.

The region to be irradiated is scanned by the particle beam because the region is typically a spatially extended region. To obtain a scanning motion at the region to be irradiated, the particle beam is deflected out of its path by small angles. The deflection is compensated for by a deflection magnet in the beam direction. The beam strikes the site to be irradiated with a parallel offset.

The beam dose in the surrounding region, which is the region not to be treated, of the body of a subject should be minimal. To minimize the beam dose in the region not to be treated, the region to be treated is irradiated from different directions, so that the beam exposure will be distributed over the largest possible volume in the surrounding tissue. Depending on the location of the region to be irradiated in the body of the subject, the direction that the particle beam strikes the region to be irradiated may be selected such that the particle beam travels the shortest possible distance through the body of the subject to the region to be irradiated.

To irradiate a subject from different directions, the particle beam, along an axis predetermined by the accelerator, is shot (directed) into a gantry that is rotatable about the axis predetermined by the particle beam.

A gantry in this connection is an arrangement of various beam guiding magnets. The beam guiding magnets deflect the particle beam multiple times out of its original direction, so that after leaving the gantry, the beam strikes the area to be irradiated at a defined angle. Typically, the particle beam strikes the region to be irradiated at an angle of 45 to 90°, relative to the axis of rotation of the gantry.

The beam guiding magnets are located on a frame, which is part of the gantry, in such a way that the particle beam emerging from the gantry always extends through a fixed region to be irradiated, called the isocenter. The region to be treated can be irradiated from a plurality of sides. The beam dose in the region surrounding the isocenter can be distributed over a large volume, so that the beam exposure outside the isocenter can be relatively slight (small). If the gantry is not rotated during the irradiation, then the gantry can be set such that the beam takes the shortest possible route through the body of the patient on its way, for example, to the growth.

For irradiating a large growth or a large tumor, not only a variation of the angle at which the particle beam strikes the region to be irradiated, but a variation in the kinetic energy of the particles and a variation of the lateral site coordinates at the point where the particle beam strikes are desirable. For varying the lateral site coordinates of the particle beam, scanner magnets are typically integrated with the gantry. With the aid of these scanner magnets, the particle beam can be deflected by small angles each in a horizontal and a vertical plane. The deflections of the particle beam that are brought about by the scanner magnets typically have to be compensated for by the magnets that follow in the beam direction in such a way that the particle beam leaves the gantry in the form of virtually parallel beams.

Because of the aforementioned conditions placed on the magnets of a gantry, ion-optical demands are made in terms of the construction of the beam guiding magnets. Coil designs known from the prior art are generally optimized with respect to these criteria.

Such beam guiding magnets have a magnetic field that cannot be ignored in their outer space. The term "outer space of the beam guiding magnet" should be understood in this connection to mean the region that is not surrounded by the individual magnet coils of the beam guiding magnet.

The magnetic flux densities of a beam guiding magnet are typically between 20 mT and 50 mT in the region of the isocenter. These magnetic fields at the site of the isocenter are undesirable. For treating patients with pacemakers, a magnetic flux density of only 0.5 mT in the region of the patient (e.g., the patient's room) and in the region of the isocenter (e.g., the region of a tumor that may be present) is permitted.

Passive magnetic shielding of the patient's room is possible. However, a passive ferromagnetic shield has a high weight. A passive magnetic shield exhibits a nonlinear behavior with regard to the interaction with the electrically charged particle beam that is deflected by the beam guiding magnet.

Depending on the energy of the electrically charged particles of the particle beam that are deflected by the beam guiding magnet, the coils of the beam guiding magnet are typically subjected to currents, adapted to the particle energy, for deflecting the particle beam. Depending on the current supplied to the coils of the beam guiding magnet, these coils generate a varying magnetic field for deflecting the particle beam, and consequently they also generate a varying remote field. The remote field of the beam guiding magnet is kept away from the patient by passive magnetic shielding that may be present. In the material comprising the passive magnetic shielding, depending on the magnetic fields acting on it, corresponding electric currents are induced that lead to the buildup of contrary magnetic fields. If the magnetic fields originating at the beam guiding magnet or the coils of the beam guiding magnet vary, then the currents induced in the passive magnetic shielding vary as well.

To irradiate a patient inside a patient's room, the passive magnetic shielding must have an aperture for the beam of electrically charged particles to pass through. In the region of the aperture, the magnetic conditions vary where the currents induced in the passive magnetic shielding are varying. Each time a coil current of an individual coil of the deflection magnet varies, the magnetic conditions in the region of the aperture of the passive magnetic shielding vary. Each time the coil current of an individual coil of the deflection magnet varies, the beam of electrically charged particles may need to be readjusted.

SUMMARY AND DESCRIPTION

The present embodiments may obviate one or more of the drawbacks or limitations inherent in the related art. For example, in one embodiment, a beam guiding magnet has a magnetic field of reduced field intensity in its outer region.

A beam guiding magnet includes a first and second coil systems, which are designed such that the dipole moments of the first and second coil systems point in opposite directions. Since the dipole moments of the first and second coil systems point in opposite directions, the two dipole moments at least partially compensate for one another. The resultant dipole moment of the beam guiding magnet may be reduced. The beam guiding magnet may take into account that the remote field of a beam guiding magnet can be lowered by a reduction in the dipole moment of the beam guiding magnet. The dipole moment decreases with the cube of the distance from the beam guiding magnet. A quadruple moment, which on attenuation of the dipole moment represents the next strongest field component, decreases with the fifth power of that distance.

In one embodiment, a beam guiding magnet is disclosed for deflecting a beam of electrically charged particles along a curved particle path that defines a beam guidance plane. The beam of electrically charged particles may be deflected along the curved particle path into an isocenter. The beam guidance plane includes at least one first coil system, with curved individual coils extending along the particle path that is arranged in pairs in mirror symmetry to the beam guidance plane. The first coil system includes at least two saddle-shaped first primary coils, with elongated side parts in the direction of the particle path and with end parts bent upward at the face end; at least two largely flat secondary coils, curved in bananalike shape, which each enclose one inner region; and at least two largely flat correction coils, curved in bananalike shape, located in the respective inner region of the secondary coils. The beam guiding magnet includes a second coil system, with two second primary coils, which are located between the first primary coils and are curved in bananalike shape and extend laterally of the particle path. The second primary coils include a first elongated, essentially flat side part close to the particle path and a second elongated, essentially flat side part remote from the particle path. Dipole moments are generated with the first and second coil systems. The dipole moments point in opposite directions.

The field in the outer space of the beam guiding magnet may be reduced because the dipole moments point in opposite directions.

In one embodiment, the first and second coil systems may be excited such that in the outer region of the beam guiding magnet, the sum of the dipole moments of the first and second coil systems is minimized. Accordingly, the stray field of the beam guiding magnet may drop with increasing distance from the beam guiding magnet. The electromagnetic compatibility of the beam guiding magnet may be improved.

In one embodiment, the first and second coil systems of the beam guiding magnet are excited such that the sum of the magnetic fields generated by the first and second coil systems is minimized, at least at the site of the isocenter. Accordingly, an interaction with other medical instruments located in the region of the patient can be reduced. For example, the interaction with medical instruments located inside the body of the patient, such as a pacemaker, may be reduced.

In one embodiment, the individual coils of the first and second coil systems are connected electrically in series. The first and second coil systems may be structurally designed such that in an outer region of the beam guiding magnet, the sum of the dipole moments of the first and second coil systems is minimized. The beam guiding magnet may have a reduced stray field.

In one embodiment, the individual coils of the first and second coil systems are connected electrically in series. The first and second coil systems are structurally designed such that at least at the site of the isocenter, the sum of the magnetic fields generated by the first and second coil systems is minimized. The beam guiding magnet may have a reduced stray field.

The magnetic field in the patient's room, for example, at the site of the isocenter, may be minimized without accepting the technical problems of passive magnetic shielding, such as high weight, the associated engineering effort, and expense, because of the active reduction in the stray field of the beam guiding magnet.

In one embodiment, the individual coils of the first and second coil systems are connected electrically in series, and the number of windings of the individual coils are dimensioned such that the sum of the dipole moments of the first and second coil systems is minimized. Accordingly, the current density in the individual coils of the beam guiding magnet is essentially the same. The dipole moments pointing in opposite directions that are generated by the first and second coil systems, respectively, may be adapted by adjusting (adapting) the number of windings of the individual coils. During the production of the individual coils, the number of windings of the individual coils may be adapted.

In one embodiment, the individual coils of the first and second coil systems may be connected electrically in series, and the second primary coils may enclose an area in the beam guidance plane that is dimensioned such that the sum of the dipole moments of the first and second coil systems is minimized. The dipole moments generated by the first and second coil systems may be adapted such that the dipole moment generated by the second coil systems is adjusted by the area enclosed by the second primary coils in the beam guidance plane. The area enclosed in the beam guidance plane by the second primary coils may be easily varied by later adjustment, since the second primary coils of the beam guiding magnet are easily accessible.

In one embodiment, the secondary coils may extend between the bent-upward end parts of their respective associated first primary coils. The beam guiding magnet may be compact.

In one embodiment, the beam guiding magnet is free of (does not include) ferromagnetic material that affects the beam guidance. By not using ferromagnetic material, the beam guiding magnet has a reduced weight. The beam guiding magnet, without ferromagnetic material, may be used to generate a magnetic field that has a field intensity which is above the ferromagnetic saturation of the ferromagnetic material.

In one embodiment, the conductors of the individual coils may include metal low-temperature superconductor (LTC) material. In one embodiment, the conductors of the individual coils include metal oxide high-temperature superconductor (HTC) material. The HTC superconductor material may be in ribbon form. The high-temperature superconductor material has higher operating temperatures than low-temperature superconductor material. Operating an individual coil that has HTC superconductor material may require less effort and expense for cooling.

In one embodiment, the conductors of the individual coils which have HTC superconductor material can be operated in a temperature range between 10K and 40K, preferably in a temperature range between 20K and 30K. In these temperature ranges, typical HTC superconductor materials have sufficiently high critical current-carrying capacities and current densities.

In one embodiment, an irradiation system includes a fixed particle source for generating a beam of electrically charged particles (particle beam). The irradiation system includes a gantry system, which is rotatable about an axis of rotation and has a plurality of deflecting and/or focusing magnets for deflecting and/or focusing the particle beam into an isocenter. The irradiation system includes at least one deflecting and/or focusing magnet that is a beam guiding magnet.

The irradiation system has a reduced stray field. The electromagnetic compatibility of the irradiation system may be improved.

In one embodiment, as the deflecting and/or focusing magnet that the particle beam passes through last before reaching the isocenter, the irradiation system may have a beam guiding magnet in accordance with one of the aforementioned embodiments. Such a deflecting and/or focusing magnet in an irradiation system that the particle beam passes through last before reaching the isocenter is as a rule located close to the patient's room. The irradiation system c may reduce the magnetic exposure in the patient's room.

In one embodiment, the irradiation system may have a beam guiding magnet whose magnetic field is minimized, at least in the patients room and preferably at least at the site of the isocenter. Minimizing the magnetic field in the patient's room, preferably at the site of the isocenter, represents a gradual improvement in the electromagnetic compatibility of the irradiation system. The irradiation system may be used to treat patients who have electromagnetically sensitive devices inside their bodies, such as a pacemaker.

In one embodiment, the particle beam comprises $C^{6+}$ particles. $C^{6+}$ particles are used in cancer therapy. An irradiation system may be suitable for cancer therapy. The irradiation system may have a reduced remote field and may cover a broader range of applications. For example, the irradiation system may be used to treat cancer patients who have an electromagnetically sensitive devices, such as a pacemaker, inside their bodies.

BRIEF DESCRIPTION OF THE DRAWINGS

FIG. 1 shows an irradiation system (radiation treatment system) 100. The irradiation system 100 includes a beam of electrically charged particles (particle beam) 102, originating at a particle source 101. The particle beam 102 may be deflected with a gantry system along a curved particle path. The particle beam 102 may be a beam of $C^{6+}$ ions. The particle beam 102 is guided inside a beam guiding tube 103. A beam guidance plane 104 is predetermined by the curved path of the particle beam 102. The particle beam 102 is deflected multiple times out of its original direction using a plurality of deflecting and/or focusing magnets 105. The original direction of the particle beam 102 may be a direction predetermined by the particle source 101. The gantry system may include deflecting and/or focusing magnets 105 and further magnets, such as scanner magnets 106. The gantry system may be rotatable about a fixed axis of rotation A. The axis of rotation A of the gantry system may be the same as the original direction of the particle beam 102 that is predetermined by the particle source 101. The gantry system may include a frame for mounting the various magnets.

The gantry system may direct the particle beam 102 into (toward) an isocenter 107. The isocenter 107 is the region in which the particle beam 102 intersects the gantry axis of rotation A. Upon a rotation of the gantry system, the particle beam 102 always passes through the isocenter 107. The isocenter 107 is located inside a patient's room 108. An irradiation system 100 may be used for cancer therapy, for example, when a tumor to be irradiated, for example, with $C^{6+}$ ions, is located in the region of the isocenter 107.

Figure 1:
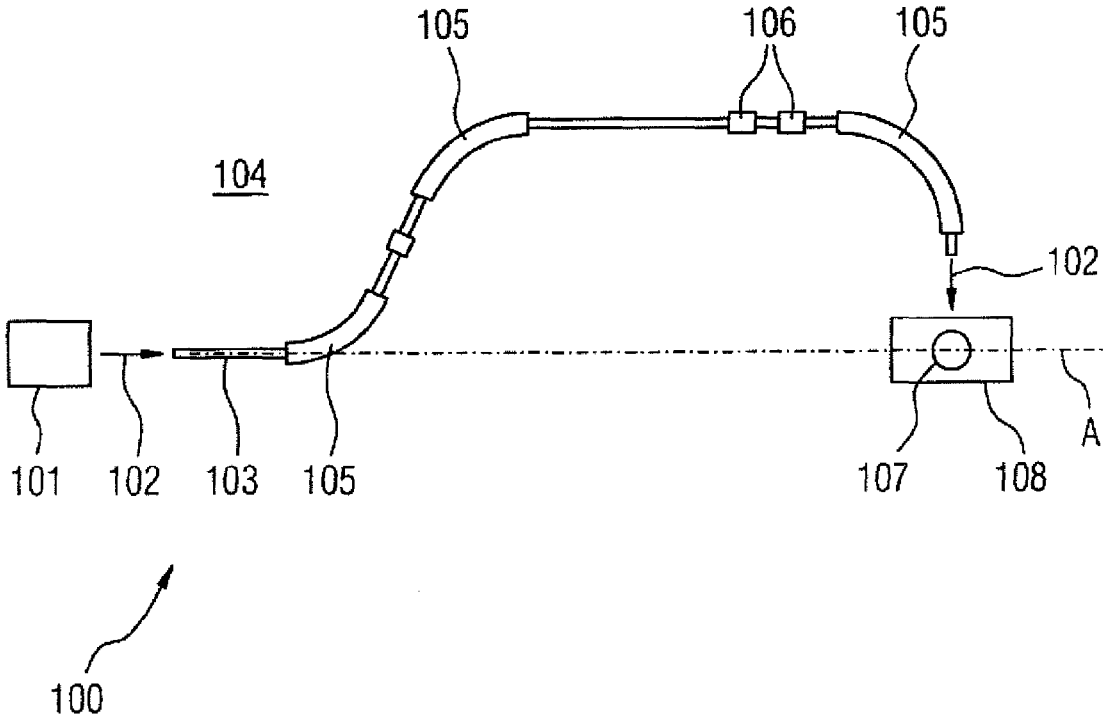
FIG. 1 shows one embodiment of an irradiation system with a gantry system.
Figure 2:
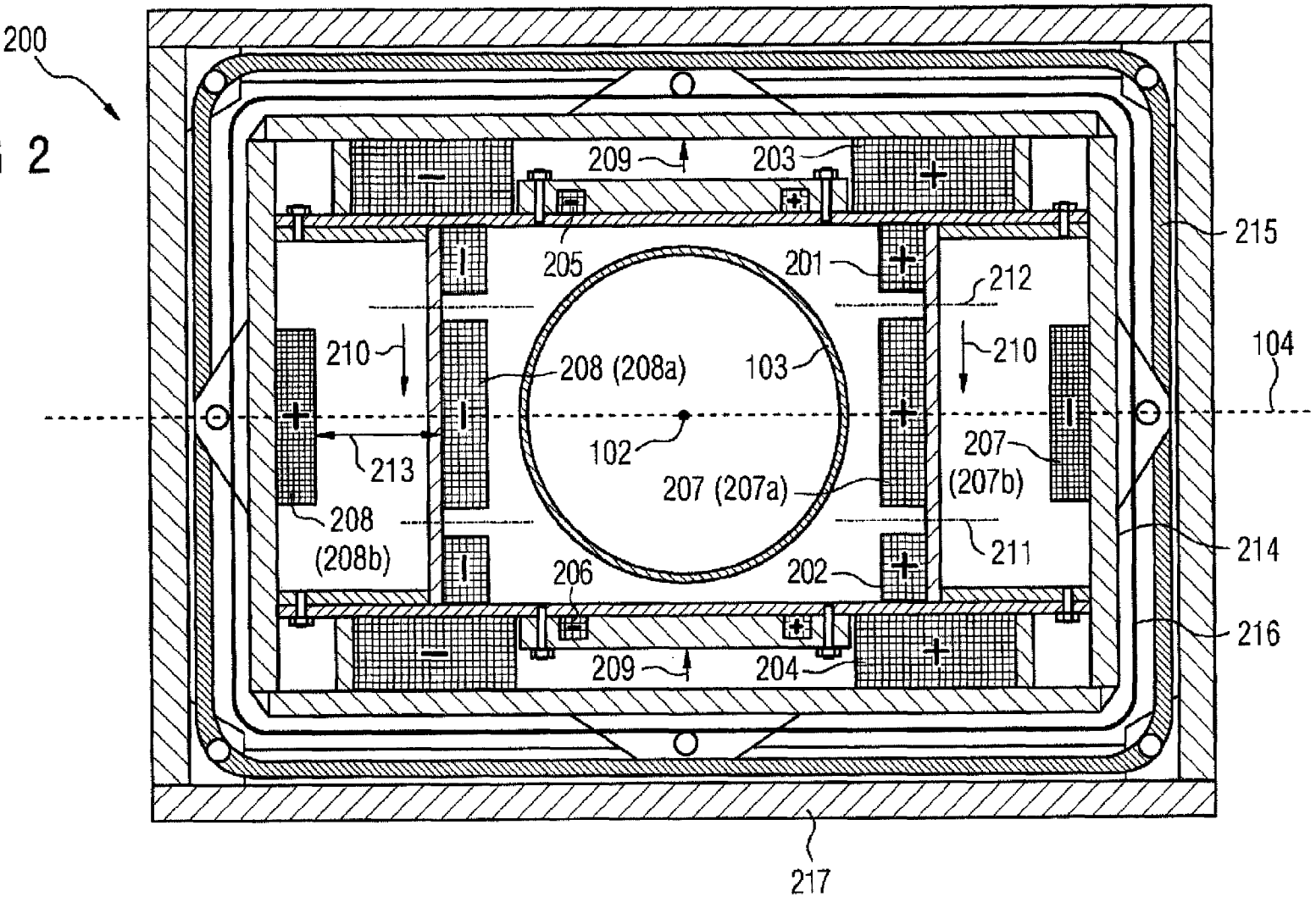
FIG. 2 shows a cross section of one embodiment of a beam guiding magnet.

FIG. 2 shows a cross section through a beam guiding magnet 200. The beam guiding magnet 200 shown in FIG. 2 may be a deflection magnet of a gantry system of the kind shown in FIG. 1. The beam guiding magnet 200 may be the magnet of the gantry system through which the particle beam 102 passes last before the particle beam 102 strikes the isocenter 107.

As shown in FIG. 2, the particle beam 102 may extend centrally inside a beam guiding tube 103. The particle beam 102 may follow a curved path, which defines a beam guidance plane 104. The beam guiding magnet, as shown in FIG. 2, may include first and second coil systems.

The individual coils of the first coil system are arranged in pairs in mirror symmetry to the beam guidance plane 104. The first coil system may include at least two first saddle-shaped primary coils 201, 202, with side parts elongated in the direction of the particle path and with end parts bent upward on the face end. The beam guiding magnet 200 includes flat secondary coils 203, 204, which are curved in a bananalike shape and in mirror symmetry with respect to the beam guidance plane 104, which each surround an inner region. In the inner region, there are two correction coils 205, 206, which are located in mirror symmetry to the beam guidance plane 104 and curved in bananalike shape.

The second coil system of the beam guiding magnet 200 includes two second primary coils 207, 208. The second primary coils 207, 208 extend along the particle path and are curved in bananalike shape. The second primary coils 207, 208 are located between the first primary coils 201, 202. The second primary coils 207, 208 include one elongated, essentially flat first side part 207*a*, 208*a* close to the particle path and essentially parallel to a corresponding second side part 207*b*, 208*b* remote from the particle path.

The individual coils of the first coil system, if they are acted upon by a current in the direction shown in FIG. 2, generate a dipole moment in a direction marked 209. The individual coils of the second coil system, if they are acted upon by a current in the direction indicated in FIG. 2, generate a dipole moment in a direction marked 210. The dipole moment generated by the first coil system points with its direction 209 at least approximately in a direction 210 that is opposite from the dipole moment that is generated by the second coil system. The dipole moment generated by the first coil system and the dipole moment generated by the second coil system cancel one another out at least partially in the outer region of the beam guiding magnet. The dipole moments of the first and second coil systems may be generated by the individual coils of the corresponding coil system in such a way that a reduction or even a minimization of the entire dipole moment is attained in the outer region of the beam guiding magnet 200. The stray field of the beam guiding magnet 200 may be reduced. In the interior of the beam guiding magnet 200, for example, in the region of the beam tube 103, the dipole moments of the first and second coil systems are added together.

The dipole component of a magnet decreases with the cube of the distance from the respective generator in the surrounding space. The quadruple moment of a magnet decreases with the fifth power of the distance from the respective generator. By reducing the dipole component in the magnetic field of a beam guiding magnet 200, the stray field may be reduced.

The beam guiding magnet 200, as shown in FIG. 2, may reduce or minimize the stray field at certain sites or in certain regions, for example, in the patient's room 108 shown in FIG. 1 or the isocenter 107. Minimization of the stray field of the beam guiding magnet 200 may be attained by designing (adjusting) the number of windings of the individual coils of the first and second coil systems. For example, the number of windings of the first primary coils 201, 202 and second primary coils 207, 208 may be adjusted.

Both the first and the second coil systems may include a common conductor. Accordingly, the current density in the interior of the individual coils of the first and second coil systems each assume an approximately constant value. The respective cross sections, in particular the cross sections of the first primary coils 201, 202 and the second primary coils 207, 208 may be adapted such that the total dipole moment of the beam guiding magnet 200 is minimized.

As shown in FIG. 2, the first primary coils 201, 202 and the second primary coils 207, 208 may be located in a common plane. The number, or cross section, which is added to the first and second primary coils, may be varied by shifting the parting planes 211, 212. An adaptation of the first dipole moment 209 and the second dipole moment 210 may be attained.

The dipole moment of the second primary coils 207, 208 may be adapted to the dipole moment generated by the first coil system (so that the dipole moments of the first and second coil systems largely cancel one another out) such that the area enclosed by the second primary coils 207, 208 in the beam guidance plane 104 is varied by adjusting the spacing 213.

The individual coils of the beam guiding magnet 200 may include metal LTC superconductor material or, at least in part, metal oxide HTC superconductor material. If HTC superconductor material is used, the beam guiding magnet 200, or its individual coils, may be operated at temperatures of between 10K and 40K, and preferably at temperatures of between 20K and 30K. The individual coils of the beam guiding magnet 200 may be mounted on an internal mounting structure 214. If the beam guiding magnet 200 has individual coils that contain superconductor material, then the individual coils may be located together with their mounting structure 214 in a cryostat 215. The cryostat 215 may be equipped with insulation provisions, such as vacuum insulation or superinsulation 216. The components of the beam guiding magnet 200 may be mounted inside a common housing 211. The beam guiding magnet 200 may be free of ferromagnetic material that affects the beam guidance.

Figure 3:
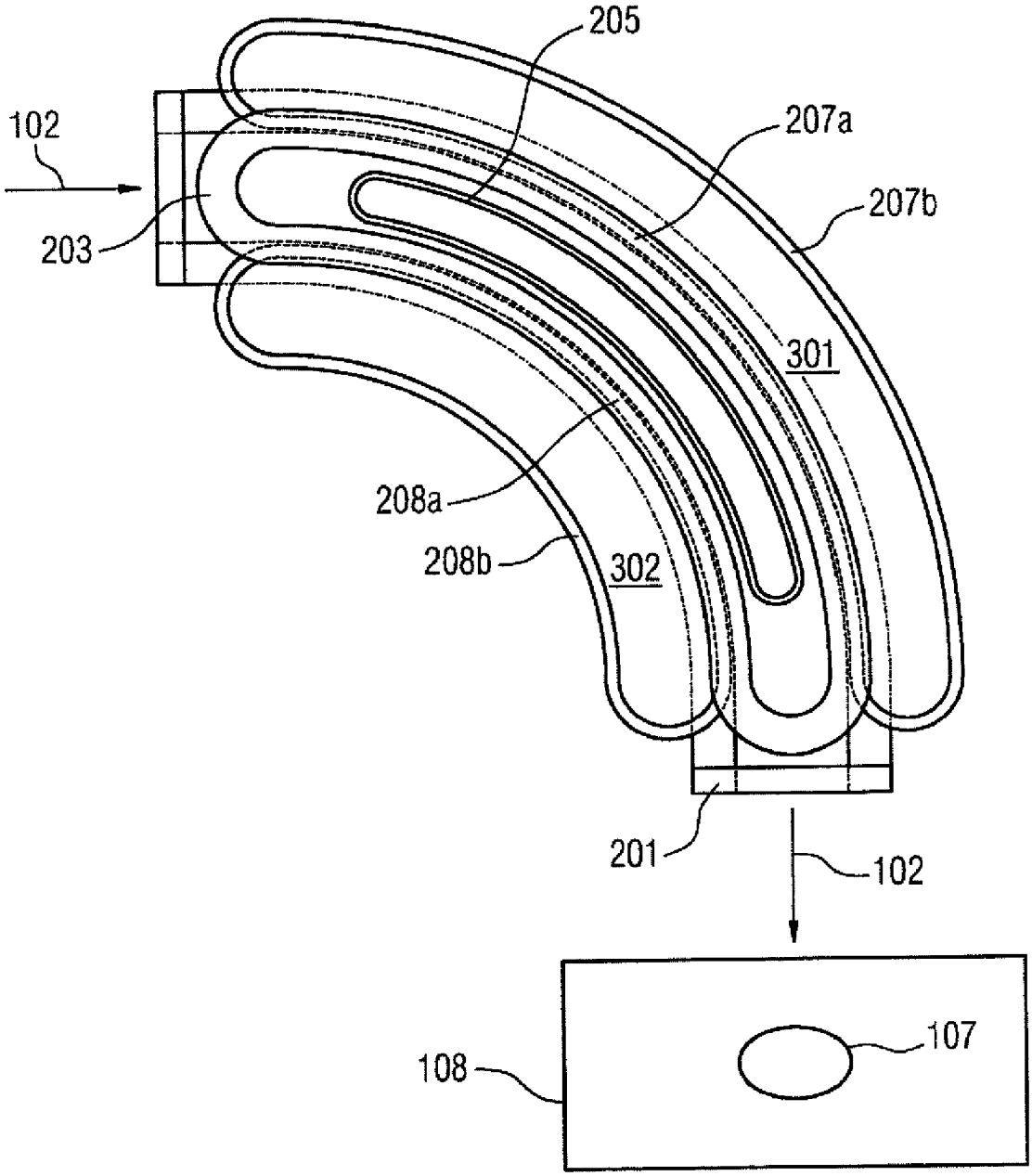
FIG. 3 shows a longitudinal section of one embodiment of a beam guiding magnet.

FIG. 3 shows a longitudinal section through the coil system of a beam guiding magnet 200 shown in FIG. 2. The particle beam 102 entering the coil system on a first side is deflected with the curved individual coils in such a way that it strikes an isocenter 107, which is located inside a patient's room 108. The spacing between the beam guiding magnet 200 and the patient's room 108 in this connection may be approximately 1 m. As shown in FIG. 3, a first primary coil 201, a secondary coil 203, and a correction coil 205 may be located in the inner region of the secondary coil 203. Relative to the curved particle path, a second primary coil 208 and further second primary coil 207 may be located on the radially inner edge of the coil system and the radially outer edge of the coil system, respectively. The second primary coils 207, 208 have an elongated, essentially flat first side part 207*a*, 208*a* close to the particle path. An elongated, essentially flat second side part 207*b*, 208*b* remote from the particle path is essentially parallel to the flat first side part 207*a*, 208*a*. The coil system may be the coil system of a beam guiding magnet 200 that a particle beam 102 passes through last before the particle beam 102 strikes an isocenter 107.

Figure 4:
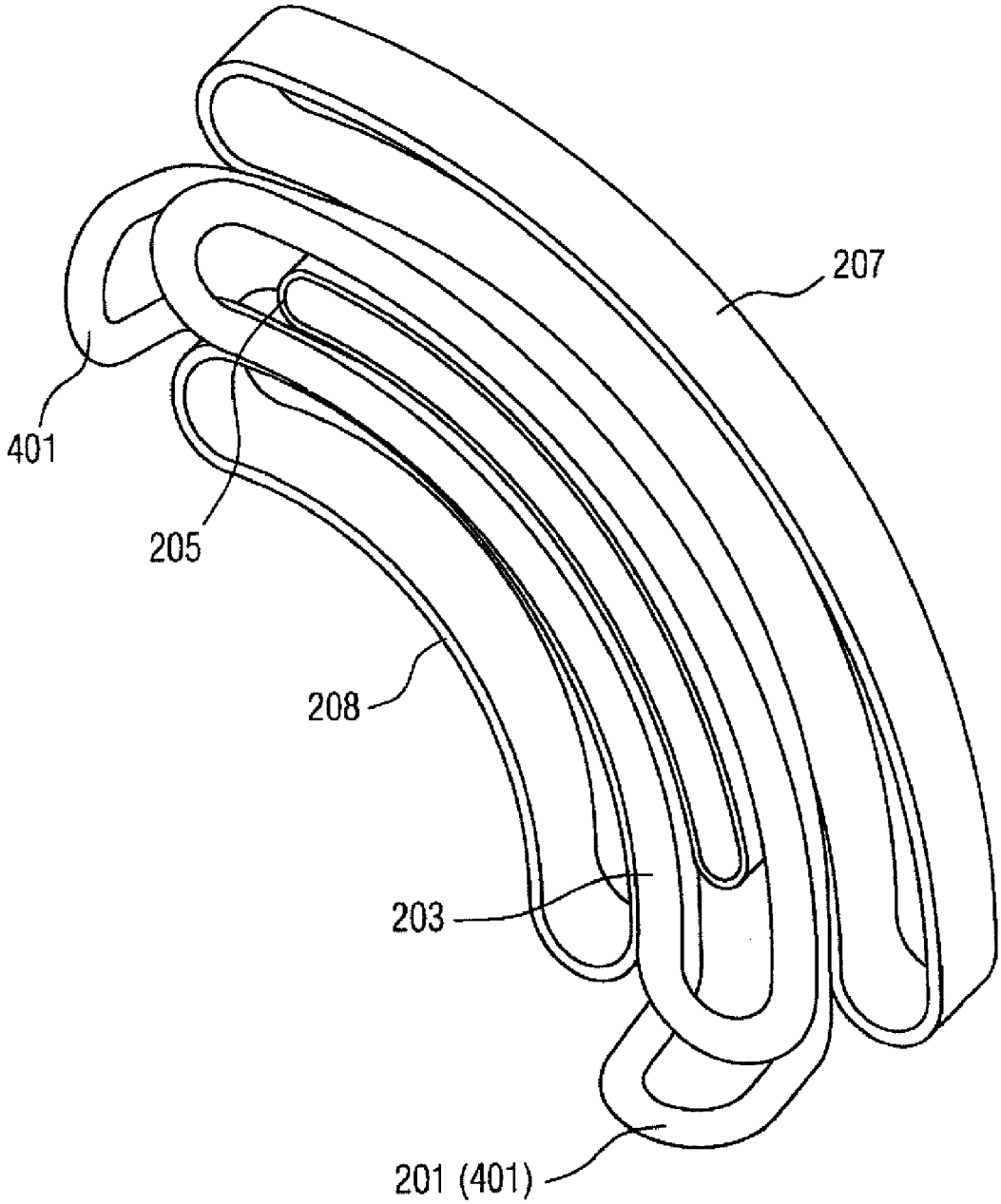
FIG. 4 shows a perspective view of one embodiment of a beam guiding magnet.

FIG. 4 shows a perspective view of the coil system of the beam guiding magnet 200 shown in FIGS. 2 and 3. FIG. 4 shows a first primary coil 201, which is bent upward on its face end regions and has offset-bent regions 401. A secondary coil 203 and the correction coil 205 are located in the inner region of the secondary coil 203. A second primary coil 207 and 208 is located on the radially inner edge of the coil system and on the radially outer edge of the coil system, respectively.

Various embodiments described herein can be used alone or in combination with one another. The forgoing detailed description has described only a few of the many possible implementations of the present invention. For this reason, this detailed description is intended by way of illustrations and not by way of limitation. It is only the following claims, including all equivalents that are intended to define the scope of this invention.

The invention claimed is:

1. A beam guiding magnet for deflecting a particle beam along a curved particle path, which defines a beam guidance plane, toward an isocenter, the beam guiding magnet comprising:

a first coil system having curved individual coils, disposed along the particle path, which are arranged in pairs in mirror symmetry to the beam guidance plane, the first coil system including two saddle-shaped first primary coils with side parts elongated in a direction of the particle path and end parts bent upward on a face end, at least two secondary coils, which are curved and surround an inner region, and at least two correction coils, which are curved and are located in the respective inner region of the secondary coils, and a second coil system having two second primary coils, which extend laterally of the particle path and are curved and which are located between the first primary coils and include a first and a second elongated side part, the first elongated side part is located close to the particle path and the second elongated side part is remote from the particle path, wherein the first and second coil systems are operable to generate dipole moments that point in opposite directions.

2. The beam guiding magnet as defined by claim 1, the dipole moment generated by the first coil system and the dipole moment generated by the second coil system substantially cancel one another out in the outer region of the beam guiding magnet.

3. The beam guiding magnet as defined by claim 1, wherein the first and second coil systems are excited such that the sum of the magnetic fields to be generated by the first and second coil systems is minimized at the site of the isocenter.

4. The beam guiding magnet claim 2, wherein the individual coils of the first and second coil systems are connected electrically in series.

5. The beam guiding magnet as defined by claim 3, wherein the individual coils of the first and second coil systems are connected electrically in series.

6. The beam guiding magnet as defined by claim 2, wherein the number of windings of the individual coils is dimensioned such that in an outer region of the beam guiding magnet, the sum of the dipole moments of the first and second coil systems is minimized.

7. The beam guiding magnet as defined by claim 2, wherein the second primary coils in the beam guidance plane enclose an area dimensioned such that in an outer region of the beam guiding magnet, the sum of the dipole moments of the first and second coil systems is minimized.

8. The beam guiding magnet as defined by claim 1, wherein the secondary coils extend between the bent-upward end parts of their respective associated first primary coils.

9. The beam guiding magnet as defined by claim 1, wherein the beam guiding magnet is free of ferromagnetic material.

10. The beam guiding magnet as defined by claim 1, wherein the conductors of the individual coils include metal low-temperature superconductor material.

11. The beam guiding magnet as defined by claim 1, wherein the conductors of the individual coils include metal oxide high-temperature superconductor material.

12. The beam guiding magnet as defined by claim 11, wherein an operating temperature of the individual coils is between 10K and 40K, preferably between 20K and 30K.

13. An irradiation system comprising:

a fixed particle source that generates a beam of electrically charged particles, and a gantry system, which is rotatable about an axis of rotation, the gantry system including a plurality of deflecting and/or focusing magnets for deflecting and/or focusing the particle beam into an isocenter, wherein at least one of the deflecting and/or focusing magnets is a beam guiding magnet as defined by claim 1.

14. The irradiation system as defined by claim 13, wherein the deflecting and/or focusing magnet that the particle beam interacts with last before reaching the isocenter is a beam guiding magnet.

15. The irradiation as defined by claim 14, wherein a magnetic field of the beam guiding magnet is minimized, at least in the patient's room, preferably at least at the site of the isocenter.

16. The irradiation system as defined by claim 13, wherein the particle beam comprises $C^{6+}$ particles.

17. The beam guiding magnet as defined by claim 1, wherein the secondary coils and correction coils are substantially flat.

18. The beam guiding magnet as defined by claim 17, wherein the secondary coils and correction coils are curved in a banana-like shape.

19. The beam guiding magnet as defined by claim 1, wherein the two second primary coils are curved in a banana-like shape.

20. The beam guiding magnet as defined by claim 19, wherein the first and second elongated side parts are essentially flat.

* * * * *